US007940006B2

(12) United States Patent
Ichikawa et al.

(10) Patent No.: US 7,940,006 B2
(45) Date of Patent: May 10, 2011

(54) PLASMA DISPLAY DEVICE

(75) Inventors: Kei Ichikawa, Osaka (JP); Masaaki Ofuji, Osaka (JP); Seiji Hamada, Osaka (JP)

(73) Assignee: Panasonic Corporation, Osaka (JP)

( * ) Notice: Subject to any disclaimer, the term of this patent is extended or adjusted under 35 U.S.C. 154(b) by 175 days.

(21) Appl. No.: 12/356,917

(22) Filed: Jan. 21, 2009

(65) Prior Publication Data

US 2009/0189525 A1 Jul. 30, 2009

(30) Foreign Application Priority Data

Jan. 30, 2008 (JP) ..... 2008-018688

(51) Int. Cl.
*H01J 17/49* (2006.01)

(52) U.S. Cl. ..... 313/582; 313/586

(58) Field of Classification Search ..... 313/495–497, 313/582–587

See application file for complete search history.

(56) References Cited

U.S. PATENT DOCUMENTS

2002/0042162 A1* 4/2002 Tone et al. ..... 438/118

FOREIGN PATENT DOCUMENTS

JP 11-272183 A 10/1999
JP 2005-72517 A 3/2005

* cited by examiner

*Primary Examiner* — Anne M Hines
(74) *Attorney, Agent, or Firm* — Hamre, Schumann, Mueller & Larson, P.C.

(57) ABSTRACT

A plasma display device includes: a plasma display panel; a front glass; a conductive filter attached to a front surface or a back surface of the front glass; a back cover; and a plurality of glass pressing pieces each of which presses a corresponding one of four sides of the front glass and makes the conductive filter and the back cover be connected electrically. Among the plurality of glass pressing pieces, glass pressing pieces disposed on one pair of opposite sides of the front glass are electrically connected with the conductive filter at the front surface side thereof, and glass pressing pieces disposed on the other pair of opposite sides of the front glass are electrically connected with the conductive filter at the back surface side thereof.

2 Claims, 7 Drawing Sheets

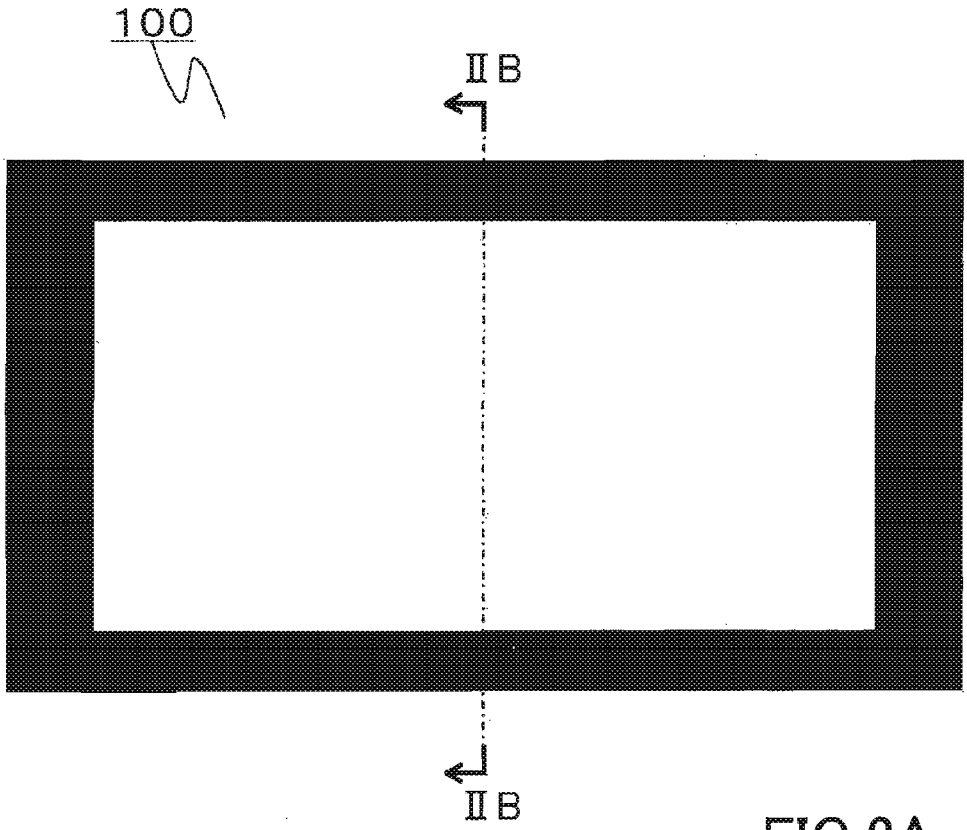
FIG.2A
FIG.2B
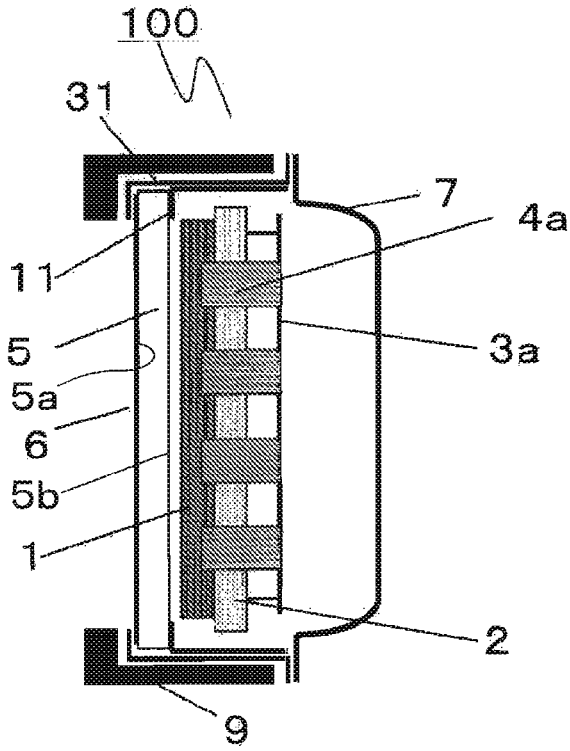

FIG.6
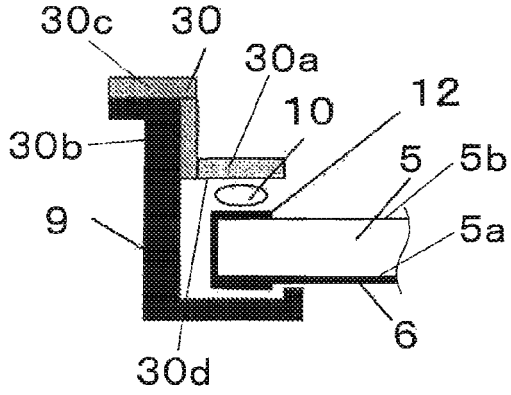
FIG.7
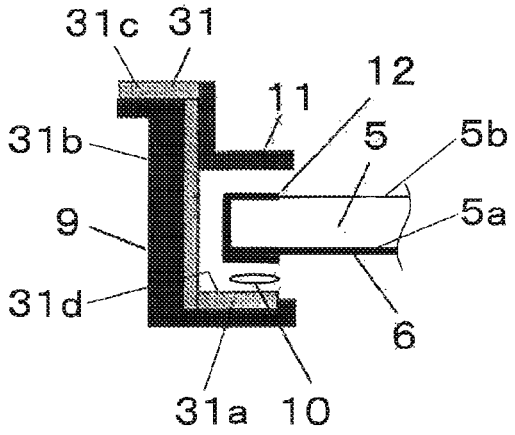
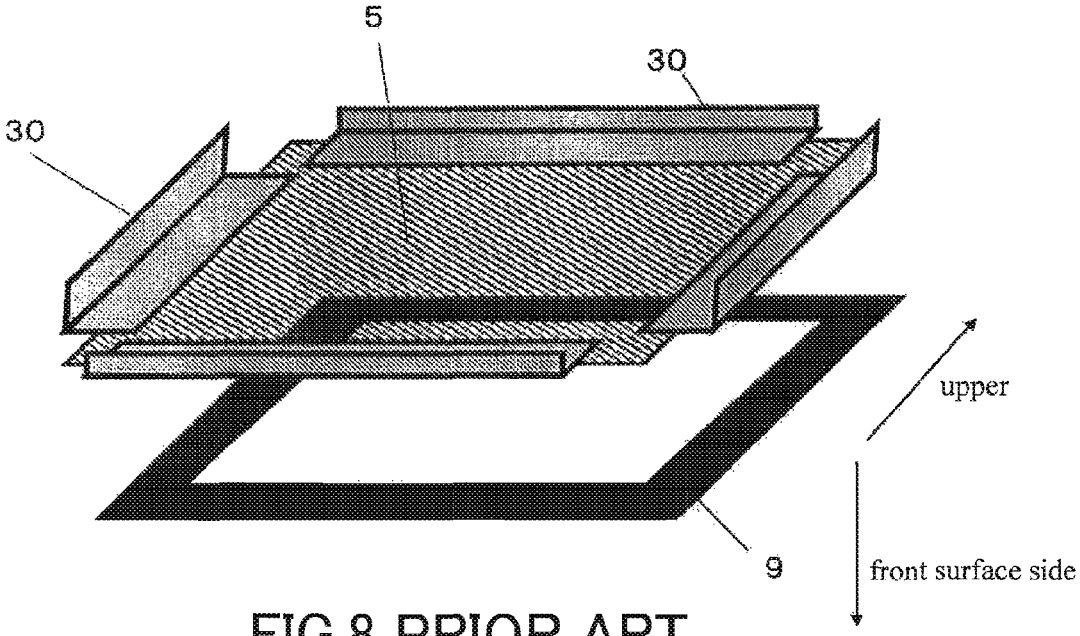
FIG.8 PRIOR ART

PLASMA DISPLAY DEVICE

BACKGROUND OF THE INVENTION

1. Field of the Invention

The present invention relates to cost reduction and noise reduction of plasma display devices.

2. Related Background Art

With the decline in prices and the development of high-quality picture technologies, plasma display devices having advantages such as thin bodies and large screen sizes have spread rapidly and have been used widely as large screen television receivers and the like.

A plasma display device includes, as main components, a plasma display panel and a shield case that encloses the plasma display panel.

This plasma display panel is a display in which ultraviolet rays generated by gas discharge excite phosphors to emit visible light as display light. In the plasma display panel, a plurality of electrodes (display electrodes and address electrodes) are arranged in a grid pattern, and discharge cells formed at respective intersections of these electrodes are made to emit light selectively. Thereby, images are formed. Based on this principle, when a drive current flows through the electrodes, this drive current generates an electromagnetic field in the plasma display panel.

The shield case encloses the plasma display panel by connecting, with conductive glass pressing pieces, a front glass attached with a conductive filter and arranged in front of the plasma display panel and a conductive back cover arranged behind the plasma display panel. Thereby, the generated electromagnetic field is shielded electromagnetically.

A contact impedance exists at each contact portion between the respective components of the shield structure. When this contact impedance increases due to poor contact between them, the shielding performance of the shield case is degraded.

As a specific example of a conventional shield structure in such a plasma display device, JP 11(1999)-272183 A discloses a structure in which glass pressing pieces and another member are integrated into one unit so as to reduce the contact impedance.

However, the above-mentioned conventional structure, in which the glass pressing pieces press the four sides of the front glass from the back surface side thereof to hold it, as disclosed in JP 11(1999)-272183 A, has the following problems.

As shown in FIG. 8, a frame 9 is arranged in front of the front glass 5 along the four sides thereof. Specifically, the front glass 5 is sandwiched between the frame 9 and glass-pressing metal pieces (glass pressing pieces) 30 so as to be held between them. A resin molded component usually is used for this frame 9 in terms of design flexibility and cost reduction. This resin molded component is, however, lower in strength than a metal. Therefore, when the front glass 5 is pressed by the glass-pressing metal pieces 30 from the back surface side thereof, the frame 9 is deformed, which causes poor electrical contact between the front glass 5 and the glass-pressing metal pieces 30. As a result, the electromagnetic field shielding effect of the shield case is deteriorated.

SUMMARY OF THE INVENTION

The present invention has achieved a solution to the above problems, and it is an object of the present invention to provide a plasma display device having a shield structure strong enough to shield the electromagnetic field without increasing the cost and man hours for assembling more than necessary.

The plasma display device according to the present invention includes: a plasma display panel having a rectangular display screen on its front surface; a plate-like front glass arranged in front of the display screen of the plasma display panel; a conductive filter attached to a front surface or a back surface of the front glass; a conductive back cover arranged behind the plasma display panel; and a plurality of glass pressing pieces each of which presses a corresponding one of four sides of the front glass and makes the conductive filter and the back cover be connected electrically. Among the plurality of glass pressing pieces, glass pressing pieces disposed on one pair of opposite sides of the front glass press the front glass from the front surface side thereof and are electrically connected with the conductive filter, and glass pressing pieces disposed on the other pair of opposite sides of the front glass press the front glass from the back surface side thereof and are electrically connected with the conductive filter.

According to the present invention, it is possible to provide a plasma display device having a shield structure strong enough to shield the electromagnetic field without increasing the cost and man hours for assembling more than necessary.

BRIEF DESCRIPTION OF THE DRAWINGS

FIG. 2A is a front view of the plasma display device according to the first embodiment of the present invention.

FIG. 2B is a vertical cross sectional view of the plasma display device according to the first embodiment of the present invention.

FIG. 6 is an enlarged view showing the connection between a front glass and right and left glass-pressing metal pieces in a plasma display device according to each of the first to third embodiments of the present invention.

FIG. 7 is an enlarged view showing the connection between the front glass and upper and lower glass-pressing metal pieces in the plasma display device according to each of the first to third embodiments of the present invention.

FIG. 8 is a perspective view showing the connection between a front glass and glass-pressing metal pieces in a conventional plasma display device.

DETAILED DESCRIPTION OF THE INVENTION

Hereinafter, embodiments of the present invention will be described with reference to the accompanying drawings. In the following embodiments, the same components are designated by the same numerals.

First Embodiment

Figure 1:
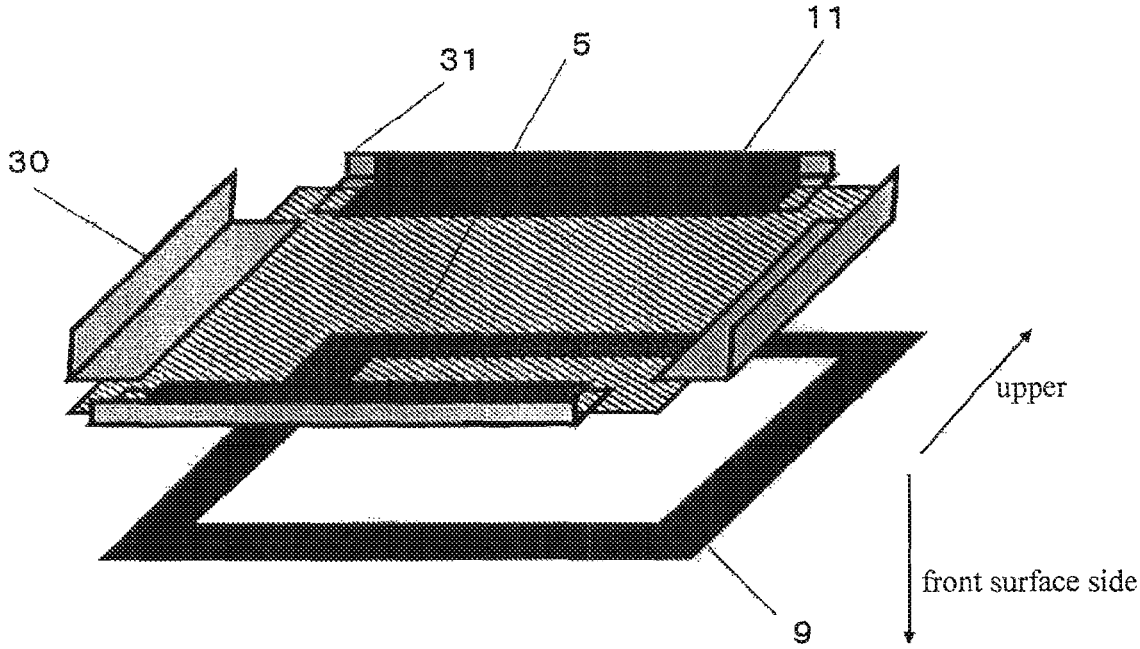
FIG. 1 is a perspective view showing the connection between a front glass and glass-pressing metal pieces in a plasma display device according to a first embodiment of the present invention.
Figure 3A:
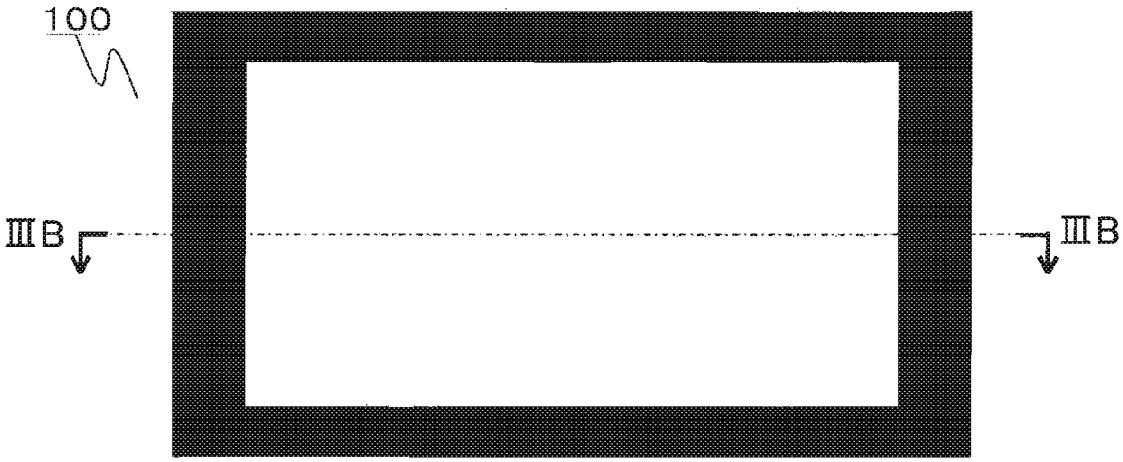
FIG. 3A is a front view of the plasma display device according to the first embodiment of the present invention.
Figure 3B:
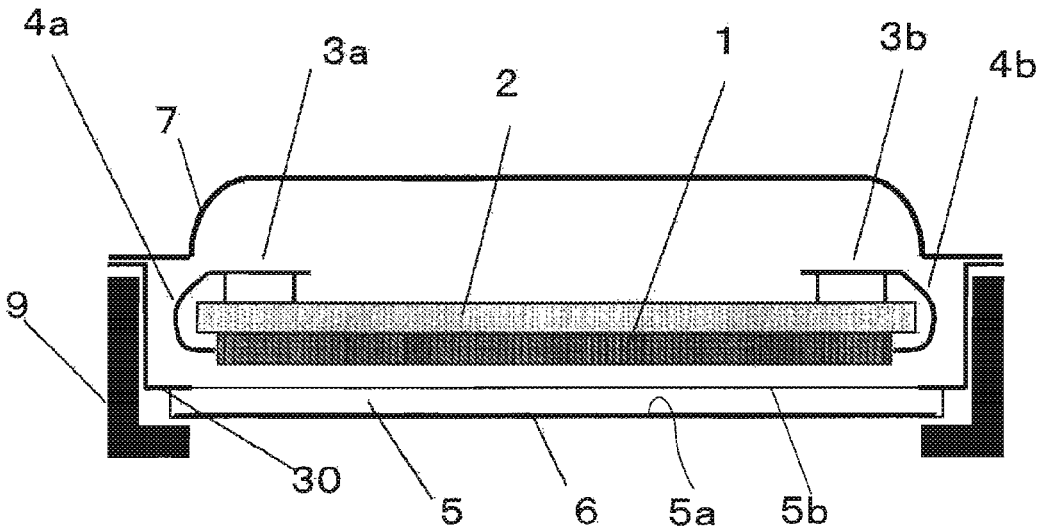
FIG. 3B is a horizontal cross sectional view of the plasma display device according to the first embodiment of the present invention.

FIG. 1 is a perspective view, seen from the back surface side of a front glass, of the connection between the front glass and glass-pressing metal pieces (glass pressing pieces) in a plasma display device 100 according to the first embodiment of the present invention. FIG. 2A is a front view showing a schematic structure of the plasma display device 100 according to the first embodiment of the present invention. FIG. 2B is a vertical cross sectional view of the plasma display device 100 taken along a line IIB-IIB of FIG. 2A. FIG. 3A is a front view showing a schematic structure of the plasma display device 100 according to the first embodiment of the present invention. FIG. 3B is a horizontal cross sectional view of the plasma display device 100 taken along a line IIIB-IIIB of FIG. 3A.

As shown in FIGS. 2A to 3B, the plasma display device 100 has a plasma display panel 1 having, on its front surface, a rectangular display screen for displaying video images.

Figure 4:
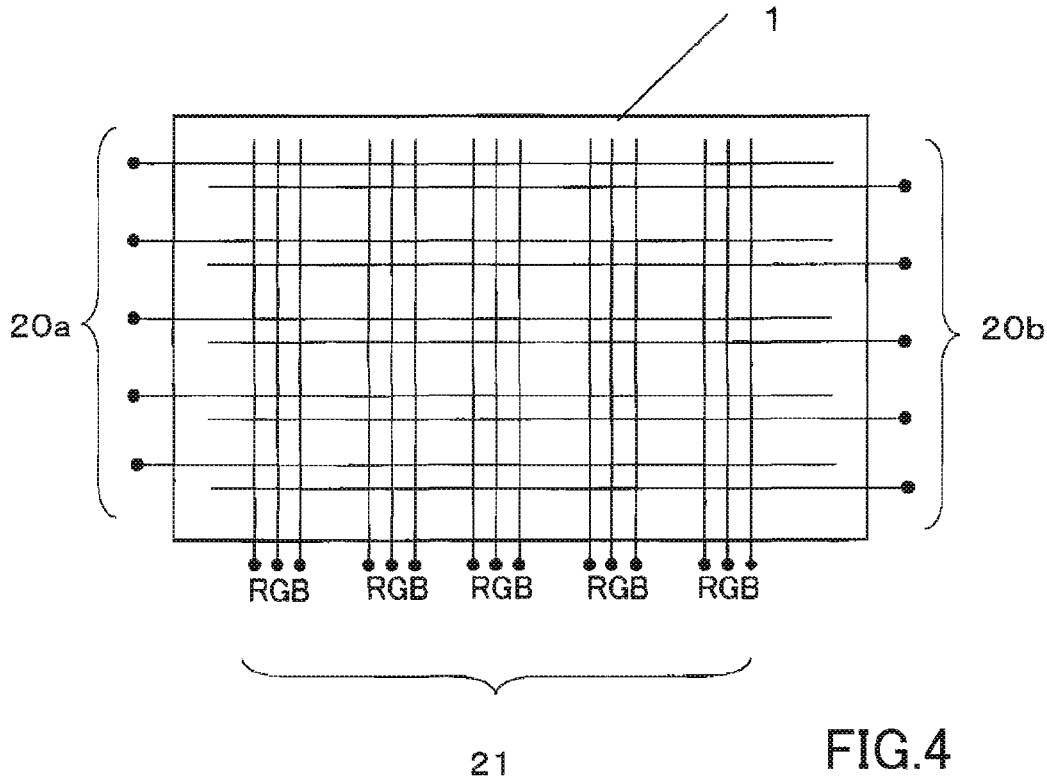
FIG. 4 is a conceptual diagram showing an arrangement of discharge electrodes in a plasma display panel.

FIG. 4 is a diagram for explaining an arrangement of discharge electrodes in the plasma display panel 1. This diagram shows, in a simplified manner, a case where there are five display lines and five display dots respectively. First, the structure of the plasma display panel 1 and the discharge mechanism of the plasma display device 100 will be described.

In the plasma display panel 1, sustain discharge electrodes (hereinafter referred to as "X electrodes") 20*a* and sustain/scan discharge electrodes (hereinafter referred to as "Y electrodes") 20*b*, each extending in the width direction (in the horizontal direction in FIG. 3B) of the plasma display panel 1, are arranged in the height direction (in the vertical direction in FIG. 2B). The number of the X electrodes and the number of the Y electrodes correspond respectively to the number of the display lines. Furthermore, address electrodes 21 for generating scan discharge with the Y electrodes are arranged so as to intersect the Y electrodes 20*b* at right angles. The number of the address electrodes corresponds to the number of the display dots. A discharge cell is formed at each intersection between a pair of an X electrode 20*a* and a Y electrode 20*b* and an address electrode 21.

As shown in FIG. 3B, the plasma display device 100 further includes: an aluminum chassis 2 disposed on the back surface (on the top in FIG. 3B) of the plasma display panel 1; a printed circuit board 3*a* on which an X electrode driving circuit for applying driving pulse waveforms to the X electrodes 20*a* is formed; a printed circuit board 3*b* on which a Y electrode driving circuit for applying driving pulse waveforms to the Y electrodes 20*b* is formed; a flexible wiring board 4*a* for connecting the X electrode driving circuit and the X electrodes 20*a*; and a flexible wiring board 4*b* for connecting the Y electrode driving circuit and the Y electrodes 20*b*.

In the plasma display device 100, the ground of the X electrode driving circuit and one of the end portions of the aluminum chassis 2 (the left end portion in FIG. 3B) are connected electrically, and the ground of the Y electrode driving circuit and the other end portion of the aluminum chassis 2 (the right end portion in FIG. 3B) are connected electrically.

A commonly-used method for driving the plasma display device 100 is a sub-field driving method in which the gray scale display is controlled by changing the number of discharges. Each sub-field includes a reset period, an address period and a sustain discharge period.

The operation of the plasma display device in these periods will be described respectively. During the reset period, a reset pulse voltage is applied between each pair of the X electrode 20*a* and the Y electrode 20*b* so as to generate a discharge in all the cells, thereby erasing the wall charges remaining in the previous sub-field. During the address period, a scan pulse voltage is applied sequentially to respective Y electrodes 20*b*, and simultaneously an address pulse voltage is applied selectively to the address electrodes 21 of the pixels corresponding to images to be displayed. This selective input of the address pulse voltage generates an address discharge between each pair of the Y electrode 20*b* and the address electrode 21. Thereby, the wall charges are accumulated in the corresponding cells. During the sustain discharge period, a sustain discharge pulse voltage is applied between each pair of the X electrode 20*a* and the Y electrode 20*b* so as to generate a sustain discharge in the cells in which the wall charges have been accumulated.

Vacuum ultraviolet rays are generated in the cells by the sustain discharge. The vacuum ultraviolet rays are radiated to phosphors arranged in the cells to emit visible light. Thereby, the corresponding pixels are lit up. During the sustain discharge period, a driving voltage of several hundreds volts and several hundreds kHz is applied alternately to the X electrodes 20*a* and the Y electrodes 20*b* so as to generate a discharge in the cells between these electrodes 20*a* and 20*b*. Thereby, during the sustain discharge period, a great amount of current flows in the plasma display panel instantaneously.

For example, when a driving voltage is applied to the X electrodes 20*a*, a great amount of current flows in a loop path from the driving portion of the X electrode driving circuit, through the X electrodes 20*a*, the atmosphere in the cells, the Y electrodes 20*b*, the ground of the Y electrode driving circuit, and the aluminum chassis 2, and back to the ground of the X electrode driving circuit. The great amount of current that flows in the loop generates a large magnetic field.

Next, a structure in the vicinity of the front glass of the plasma display device 100 according to the present embodiment will be described. As shown in FIGS. 2B and 3B, the plasma display device 100 has a front glass 5 arranged in front of and parallel to the display screen of the plasma display panel 1. This front glass 5 has a front surface 5*a* that faces the side opposite to the plasma display panel 1 and a back surface 5*b* that faces the plasma display 1. The front glass 5 has a rectangular shape having longer sides extending in the horizontal direction when viewed from the front side thereof. Specifically, the upper and lower end portions of the front glass 5 constitute a pair of long sides that oppose each other in the vertical direction, while the right and left end portions thereof constitute a pair of shorter sides that oppose each other in the horizontal direction. In the present embodiment, a conductive filter 6 is attached to approximately the entire area of the front surface 5*a* of the front glass 5.

As shown in FIG. 1, in the plasma display device 100 of the present embodiment, the following two types of connecting structures are employed. In the short direction (i.e., vertical direction in the present embodiment) of the display screen of the plasma display device 100, a front surface side connecting structure in which the front glass 5 is sandwiched between the glass-pressing metal pieces (glass pressing pieces) 31 and auxiliary pressing pieces 11 is employed. In the horizontal direction, a back surface side connecting structure in which the front glass 5 is sandwiched between the glass-pressing metal pieces (glass pressing pieces) 30 and the frame 9 is employed. The glass-pressing metal pieces 30 and 31 are connected to the back cover 7 (see FIGS. 2B and 3B) so as to form a shield case.

FIG. 6 shows the details of the back surface side connecting structure, and FIG. 7 shows the details of the front surface side connecting structure.

FIG. 6 is an enlarged sectional view showing the back surface side connection in which each of the glass-pressing metal pieces 30 disposed on the opposite shorter sides of the front glass 5 presses the corresponding shorter side of the front glass 5 from the back surface 5*b* side so as to be electrically connected with the conductive filter 6. Since the conductive filter 6 is attached to the front surface 5*a* of the front glass 5, a conductive tape 12 is applied from the end portion of the conductive filter 6 to the back surface 5*b* of the front glass 5 in order to ensure conduction at the end portion of the front glass 5. A gasket 10 is a conductor having elasticity for ensuring electrical contact between the conductive filter 6 and the glass-pressing metal piece 30 through the conductive tape 12. The glass-pressing metal piece 30 and the back cover 7 are connected to each other electrically.

Specifically, the glass-pressing metal pieces 30 each are a conductive member formed by pressing a strip-shaped metal plate. The glass-pressing metal piece 30 has a pressing portion 30*a* that extends along and parallel to the shorter side of the front glass 5 on the back surface 5*b* side thereof, a fixed portion 30*c* that is fastened to the frame 9 together with the back cover 7 with screws or the like, and a connecting portion 30*b* for connecting the pressing portion 30*a* and the fixed portion 30*c*. The pressing portion 30*a* has a pressing surface 30*d* for pressing the front glass 5. This pressing surface 30*d* faces the back surface 5*b* of the front glass 5. When the fixed portion 30*c* of the glass-pressing metal piece 30 is fastened to the frame 9, the pressing surface 30*d* presses the front glass 5 from the back surface 5*b* side thereof via the gasket 10 and the conductive tape 12. Thereby, the glass-pressing metal piece 30 is electrically connected with the conductive filter 6 through the gasket 10 and the conductive tape 12.

FIG. 7 is an enlarged sectional view showing the front surface side connection in which each of the glass-pressing metal pieces 31 disposed on the opposite longer sides of the front glass 5 presses the longer side of the front glass 5 from the front surface 5*a* side so as to be electrically connected with the conductive filter 6. The conductive filter 6 attached to the front glass 5 and the glass-pressing metal piece 31 are electrically connected with each other through the gasket 10 on the front surface 5*a* side of the front glass 5. The glass-pressing metal piece 31 further is equipped with an auxiliary pressing piece 11 for sandwiching the front glass 5 therebetween. The glass-pressing metal piece 31 and the back cover 7 are connected to each other electrically as they are in the back surface side connecting structure. In the present embodiment, the conductive tape 12 is applied not only to the shorter sides of the front glass 5 but also to the longer sides thereof.

Specifically, the glass-pressing metal pieces 31 each are a conductive member formed by pressing a strip-shaped metal plate. The glass-pressing metal piece 31 has a pressing portion 31*a* that extends along and parallel to the longer side of the front glass 5 on the front surface 5*a* thereof, a fixed portion 31*c* that is fastened to the frame 9 together with the back cover 7 with screws, and a connecting portion 31*b* for connecting the pressing portion 31*a* and the fixed portion 31*c*. The connecting portion 31*b* of the glass-pressing metal piece 31 is longer than the connecting portion 30*b* of the glass-pressing metal piece 30. The pressing portion 31*a* has a pressing surface 31*d* for pressing the front glass 5. This pressing surface 31*d* faces the front surface 5*a* of the front glass 5. When the front glass 5 is pressed forward by the auxiliary pressing piece 11, the pressing surface 31*d* of the glass-pressing metal piece 31 presses the front glass 5 from the front surface 5*a* side via the gasket 10, the conductive tape 12 and the conductive filter 6. Thereby, the glass-pressing metal piece 31 is electrically connected with the conductive filter 6 through the gasket 10 and the conductive tape 12.

Assume that the back surface side connecting structure as shown in FIG. 6 is applied to all the four sides of the front glass 5 as shown in FIG. 8. In this case, the frame 9 that is a resin molded product is pressed by the glass-pressing metal pieces 30 and deformed forward. As a result, the electrical contact between the glass-pressing metal pieces 30 and the conductive filter 6 becomes poor, and thus the shielding effect is reduced. To alleviate this problem, it is necessary to increase the thickness of the gasket 10, for example.

In contrast, the present embodiment has the following advantage. According to the connecting structure of the present embodiment, the glass pressing pieces 31 disposed on one pair of opposite sides of the front glass 5 are electrically connected with the conductive filter 6 on the front surface 5*a* side of the front glass 5, and the glass pressing pieces 30 disposed on the other pair of opposite sides of the front glass 5 are electrically connected with the conductive filter 6 on the back surface 5*b* side of the front glass 5. Accordingly, even if the front glass 5 is pressed by the glass-pressing metal pieces 30 from the back surface 5*b* side thereof, the glass-pressing metal pieces 31 disposed on the front surface 5*a* side of the front glass 5 prevent the pressure from being applied to the frame 9 directly, thus preventing the frame 9 from being deformed. As a result, it is possible to prevent the reduction of electrical contact between the glass-pressing metal pieces 30 and 31 and the conductive filter 6 and thus maintain a high shielding effect. Furthermore, in the present embodiment, the contact area between the conductive tape 12 and the conductive filter 6 is pressed directly by the glass-pressing metal piece 31. Therefore, the increase of contact resistance caused by the peeling or the like in this contact area also can be suppressed.

Furthermore, even if the thickness of the gasket 10 provided between the front glass 5 and the glass-pressing metal pieces 30 and 31 is decreased, since the frame 9 is hardly deformed, the electrical contact between the glass-pressing metal pieces 30 and 31 and the conductive filter 6 can be maintained sufficiently. In addition, the present embodiment employs a structure in which two pairs of opposite sides press against each other to hold the front glass 5, which allows the front glass 5 to be held in a stable manner.

In the present embodiment, the conductive tapes 12 are applied also on the upper and lower sides, but the present invention is not limited to this structure. It is also possible to bring the glass-pressing metal pieces 31 into direct contact with the conductive filter 6 without the conductive tapes 12. In this case, the contact resistance and the cost further can be reduced.

In the present embodiment, the upper and lower sides of the front glass 5 are pressed by using the auxiliary pressing pieces 11 secondarily, but the present invention is not limited to this structure. Since the front glass 5 is pressed by the right and left glass-pressing metal pieces 30 from the back surface side thereof, the front glass 5 can be held in a stable manner even without the auxiliary pressing pieces 11. In this case, the cost can be reduced further.

Furthermore, in the present embodiment, the glass-pressing metal pieces 31 disposed on the upper and lower sides of the front glass 5 are electrically connected with the conductive filter 6 from the front surface 5*a* side of the front glass 5, and the glass-pressing metal pieces 30 disposed on the right and left sides of the front glass 5 are electrically connected with the conductive filter 6 from the back surface 5*b* side thereof. However, the present invention is not limited to this structure. For example, the glass-pressing metal pieces disposed on the right and left sides may be electrically connected with the conductive filter 6 from the front surface 5*a* side, and the glass-pressing metal pieces disposed on the upper and lower sides may be electrically connected with the conductive filter 6 from the back surface 5*b* side. In this case, if the auxiliary pressing pieces 11 are used secondarily, it is possible to shorten the length of the auxiliary pressing pieces 11 in the right-and-left arrangement relative to the upper-and-lower arrangement. Therefore, the cost can be reduced.

However, the structure in which the glass-pressing metal pieces disposed on the upper and lower sides of the front glass 5 are electrically connected with the conductive filter 6 from the front surface 5*a* side has the following advantageous effects over the structure in which the glass-pressing metal pieces disposed on the right and left sides are electrically connected with the conductive filter 6 from the front surface 5*a* side.

Figure 5:
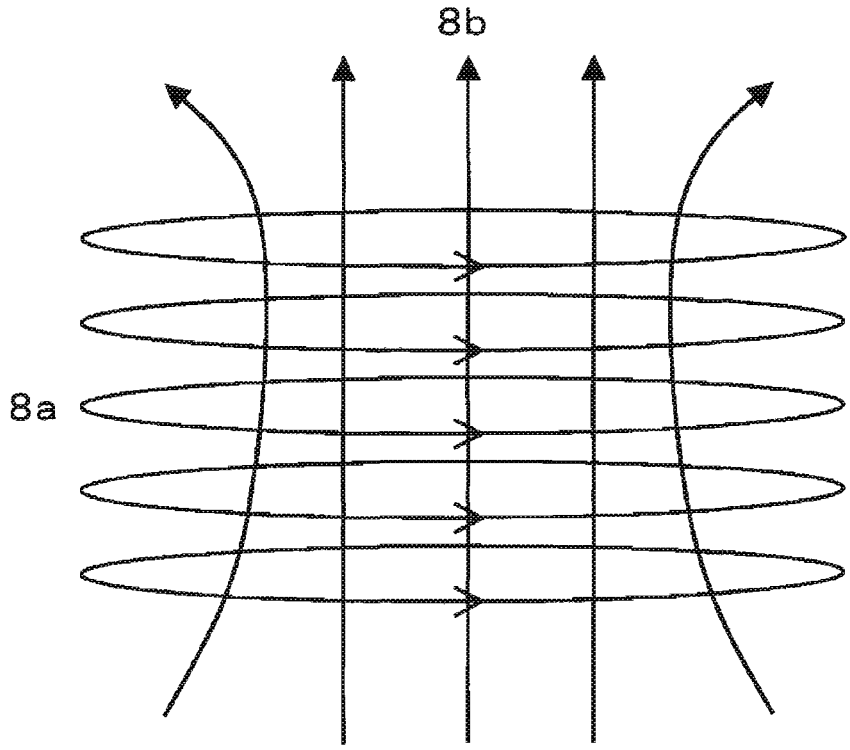
FIG. 5 is a conceptual diagram showing loop currents and a magnetic field generated thereby in a plasma display panel.

FIG. 5 is a diagram showing loop currents and a magnetic field generated thereby. As shown in FIG. 5, when loop currents 8*a* flow, a strong magnetic field 8*b* is generated in the direction perpendicular to the loop plane. On the other hand, a magnetic field generated in the direction parallel to the loop plane is weaker than that generated in the perpendicular direction.

Assume that this principle is applied to the structure as shown in FIG. 3. During the display operation in the plasma display device 100, a drive current flows in the horizontal direction to form a loop mainly between the printed circuit board 3*a*, on which the X electrode driving circuit is formed, and the printed circuit board 3*b*, on which the Y electrode driving circuit is formed, through the plasma display panel 1 and the aluminum chassis 2. In the magnetic field that is generated by this current and radiates unnecessary electromagnetic waves, vertical components (perpendicular to the plane of FIG. 3B) are dominant, and horizontal components (parallel to the plane of FIG. 3B) are few. Therefore, to prevent the unnecessary radiation of electromagnetic waves, the vertical direction shielding of the plasma display device 100 has a greater influence.

Accordingly, the present embodiment, in which the front surface side connecting structure having a stronger contact is employed on the upper and lower sides while the right and left sides are pressed from the back surface side, makes it possible to achieve a higher shielding effect than the case where the front surface side connecting structure is employed on the right and left sides.

Second Embodiment

Next, the second embodiment of the present invention will be described with reference to FIG. 9. The second embodiment differs from the first embodiment in that the right and left glass-pressing metal pieces and the upper and lower glass-pressing metal pieces respectively have portions to be laid one on the other and sandwich the front glass therebetween by connecting the portions.

Figure 9:
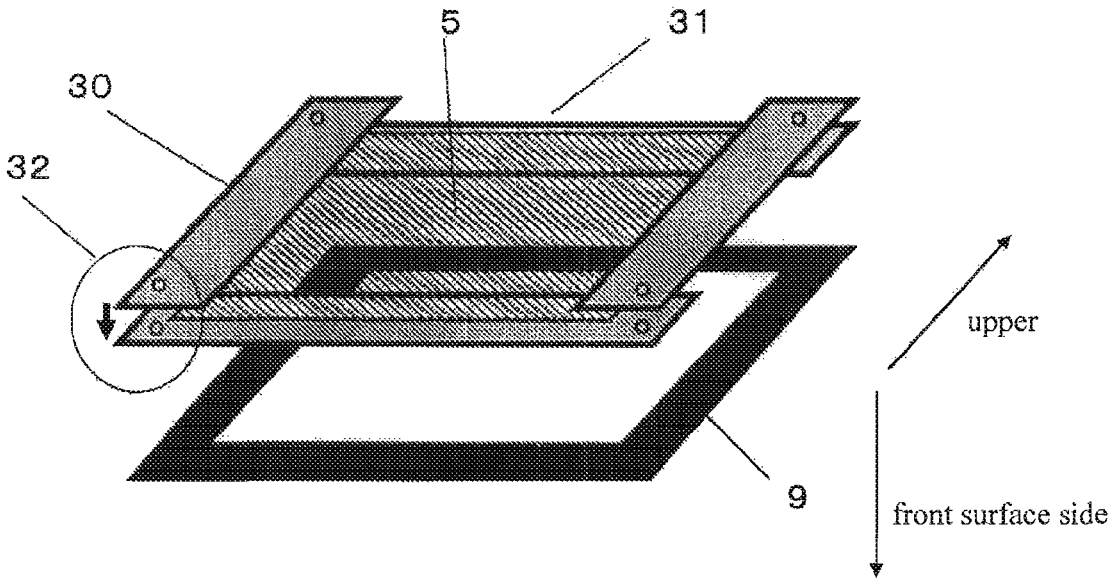
FIG. 9 is a perspective view showing the connection between a front glass and glass-pressing metal pieces in a plasma display device according to a second embodiment of the present invention.

FIG. 9 is a perspective view showing the connection between the front glass 5 and the glass-pressing metal pieces 30 and 31 in a plasma display device 100 according to the second embodiment of the present invention. The cross sectional structures between the front glass 5 and the right and left glass-pressing metal pieces 30 and the upper and lower glass-pressing metal pieces 31 are the same as those shown in FIGS. 6 and 7 in the first embodiment.

The right and left glass-pressing metal pieces 30 and the upper and lower glass-pressing metal pieces 31 respectively have connecting portions 32 to be connected with each other with connecting parts in such a manner that the connecting portions are laid one on the other. When the connecting portions 32 are fastened to each other with screws or the like (i.e., connecting parts), the right and left glass-pressing metal pieces 30 and the upper and lower glass-pressing metal pieces 31 apply pressure to the front glass 5 from both the front surface 5*a* side and the back surface 5*b* side, with the front glass 5 being sandwiched therebetween. Thus, the front glass 5 is held. As a result, the electrical contact between the glass-pressing metal pieces 30 and 31 and the conductive filter 6 also can be maintained sufficiently.

Moreover, since the plasma display device 100 of the second embodiment does not need the auxiliary pressing pieces 11, it can be realized at lower cost than that of the first embodiment.

In the present embodiment, screws are used as the connecting parts, but the present invention is not limited thereto as long as they connect the right and left glass-pressing metal pieces 30 and the upper and lower glass-pressing metal pieces 31 to each other. For example, the plasma display device 100 of the second embodiment may have a structure in which one end of a glass-pressing metal piece 30 and one end of a glass-pressing metal piece 31 are hooked to each other with a hook-like part, while the other end of the glass-pressing metal piece 30 and the other end of the glass-pressing metal piece 31 are screwed to each other with a screw. The cost of the connecting parts can be reduced by employing this connection structure.

Third Embodiment

Next, the third embodiment of the present invention will be described with reference to FIG. 10. The third embodiment differs from the first embodiment in that the upper and lower glass-pressing metal pieces each have a shape that bulges from both ends toward the center in a smooth curve.

Figure 10:
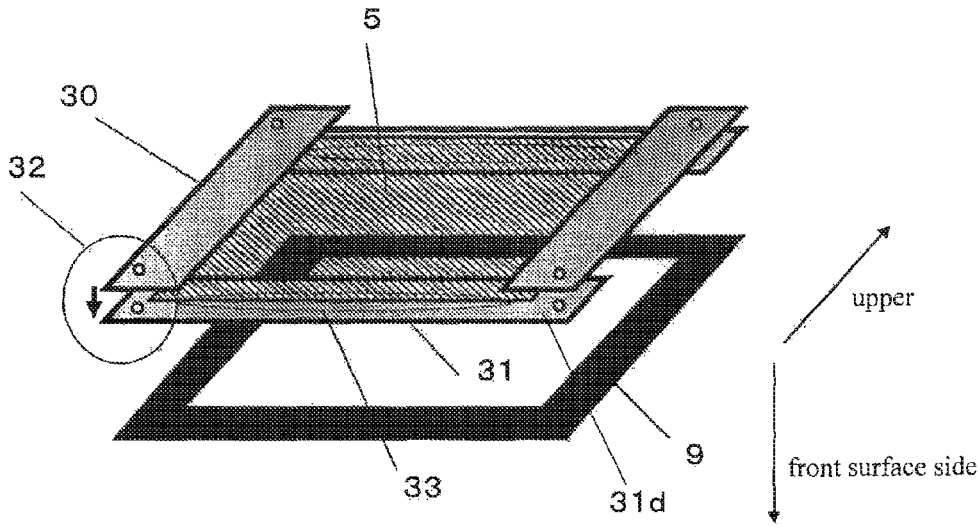
FIG. 10 is a perspective view showing the connection between a front glass and glass-pressing metal pieces in a plasma display device according to a third embodiment of the present invention.

FIG. 10 is a perspective view showing the connection between the front glass 5 and the glass-pressing metal pieces 30 and 31 in a plasma display device 100 according to the third embodiment of the present invention. The cross sectional structures between the front glass 5 and the right and left glass-pressing metal pieces 30 and the upper and lower glass-pressing metal pieces 31 are the same as those shown in FIGS. 6 and 7 in the first embodiment.

Figure 11:
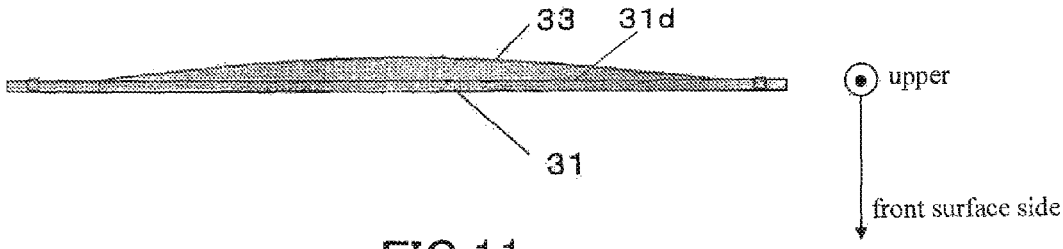
FIG. 11 is a diagram showing the structure of a convex shape portion of the glass-pressing metal piece in the plasma display device according to the third embodiment of the present invention.

The glass-pressing metal pieces 31 each have, on its pressing surface 31*d*, a convex shape portion 33 that bulges from both ends toward the center in a smooth curve in its longitudinal direction. FIG. 11 shows a cross sectional view of the glass-pressing metal piece 31 viewed from underneath. The convex portion 33 extends parallel to the longitudinal direction of the pressing surface 31*d* between the connecting portions 32 on both ends of the glass-pressing metal piece 31, and has a shape that bulges from both ends toward the center in a smooth curve. In this structure, when the connecting portions 32 of the right and left glass-pressing metal pieces 30 and the connecting portions 32 of the upper and lower glass-pressing metal pieces 31 are fastened with each other with screws, the glass-pressing metal pieces 31, even near the center of their longitudinal direction, can be contacted with the front glass 5 with a stronger pressure than that in the second embodiment.

Thus, they can be contacted sufficiently with each other. In addition, it is possible to reduce the contact impedance and thereby improve the shielding effect.

In the present embodiment, the convex shape portions 33 are provided only on the pressing surfaces 31*d* of the upper and lower glass-pressing metal pieces 31, but the present invention is not limited to this structure. The convex shape portions 33 may be provided only on the pressing surfaces 30*d* of the right and left glass-pressing metal pieces 30, or may be provided on the pressing surfaces 30*d* and 31*d* of all the upper and lower and right and left glass-pressing metal pieces 30 and 31. Furthermore, the convex shape portions 33 may be provided in the case where like the first embodiment, the glass-pressing metal pieces 30 and 31 have no connecting portions 32.

In the above-mentioned first through third embodiments, the conductive filter 6 is attached to the front surface 5*a* of the front glass 5. However, the present invention is also applicable to the case where the conductive filter 6 is attached to the back surface 5*b* of the front glass 5.

The invention may be embodied in other forms without departing from the spirit or essential characteristics thereof. The embodiments disclosed in this specification are to be considered in all respects as illustrative and not limiting. The scope of the invention is indicated by the appended claims rather than by the foregoing description, and all changes which come within the meaning and range of equivalency of the claims are intended to be embraced therein.

Industrial Applicability

The present invention is applicable to reduction of unnecessary radiation of electromagnetic waves in a plasma display panel device.

What is claimed is:

1. A plasma display device comprising:

a plasma display panel having a rectangular display screen on its front surface;

a plate-like front glass arranged in front of the display screen of the plasma display panel;

a conductive filter arranged on a front surface of the front glass;

a conductive back cover arranged behind the plasma display panel; and a plurality of glass pressing pieces each of which is arranged at a corresponding one of four sides of the front glass and makes electrical connection between the conductive filter and the back cover, wherein the glass pressing pieces disposed on one pair of opposite sides of the front glass are electrically connected with the conductive filter on the front surface side of the front glass, and a pair of conductive tapes are arranged at the other pair of opposite sides of the front glass from the conductive filter to the back surface of the front glass, and the glass pressing pieces disposed on the other pair of opposite sides of the front glass are electrically connected with the conductive filter through the conductive tape on the back surface side of the front glass.

2. The plasma display panel according to claim 1, wherein the glass pressing pieces disposed on the one pair of opposite sides of the front glass and the glass pressing pieces disposed on the other pair of opposite sides thereof respectively have connecting portions that are connected with each other in such a manner that the connecting portions are laid one on the other, and by the connection between the connecting portions, the glass pressing pieces disposed on the one pair of opposite sides of the front glass and the glass pressing pieces disposed on the other pair of opposite sides thereof hold the front glass so as to press the front glass from both the front surface side and the back surface side thereof.

* * * * *